United States Patent [19]

Tate, Jr. et al.

[11] Patent Number: 4,665,708

[45] Date of Patent: May 19, 1987

[54] ICE MAKER ASSEMBLY AND METHOD OF ASSEMBLY

[75] Inventors: Ralph Tate, Jr., Center Township, Vanderburgh County; Stephen W. Paddock, Scott Township, Vanderburgh County, both of Ind.

[73] Assignee: Whirlpool Corporation, Benton Harbor, Mich.

[21] Appl. No.: 914,195

[22] Filed: Oct. 1, 1986

Related U.S. Application Data

[62] Division of Ser. No. 810,074, Dec. 17, 1985.

[51] Int. Cl.[4] ..... F25C 1/04; H05K 13/00

[52] U.S. Cl. ..... 62/66

[58] Field of Search ..... 62/66, 340; 339/126 R, 339/214 R, 214 C, 214 S, 215 R, 215 S; 174/52 R; 29/592, 854

[56] References Cited

U.S. PATENT DOCUMENTS

| | | | |
|---|---|---|---|
| 1,930,523 | 10/1933 | Landon | 174/52 R X |
| 2,694,249 | 11/1954 | Kapp | 29/155.5 |
| 3,012,172 | 12/1961 | Kammar et al. | 174/52 R X |
| 3,163,018 | 12/1964 | Shaw | 62/137 |
| 3,217,510 | 11/1965 | Kniffin et al. | 62/353 |
| 3,276,225 | 10/1966 | Linstromberg | 62/353 |
| 3,340,436 | 9/1967 | Jones et al. | 317/101 |
| 3,651,446 | 3/1972 | Sadogierski et al. | 339/126 R X |
| 3,668,476 | 6/1972 | Wrabel et al. | 317/101 DH |
| 3,694,674 | 9/1972 | Inoue | 174/52 R X |
| 4,039,902 | 8/1977 | Lacan et al. | 361/395 |

FOREIGN PATENT DOCUMENTS

| | | | |
|---|---|---|---|
| 206475 | 12/1959 | Fed. Rep. of Germany | 174/52 R |
| 739199 | 10/1955 | United Kingdom | 174/52 R |

*Primary Examiner*—William E. Tapolcai

*Attorney, Agent, or Firm*—Wood, Dalton, Phillips Mason & Rowe

[57] ABSTRACT

An ice maker assembly and method of assembling the same wherein the electrical connections between electrical structure carried by the mold and an intermediate support, and contacts carried by a control means also mounted to the support are made solely as an incident of the assembly of the mold, support and control means. In the illustrated embodiment, the assembly is effected along a single axle. Illustratively, the electrical components so connected include a heater carried by the mold, a thermostat carried by the support for thermal transfer association with the mold in the assembled arrangment of the structure, and a grounding pin carried by the mold. The support is provided with suitable openings for passing the electrical connection components therethrough to have automatic electrical connection with complementary contact elements carried by the control means. The assembled support and control mechanism may be removed as a unit from the mold to provide access to the mold heater and thermostat for facilitated replacement.

13 Claims, 4 Drawing Figures

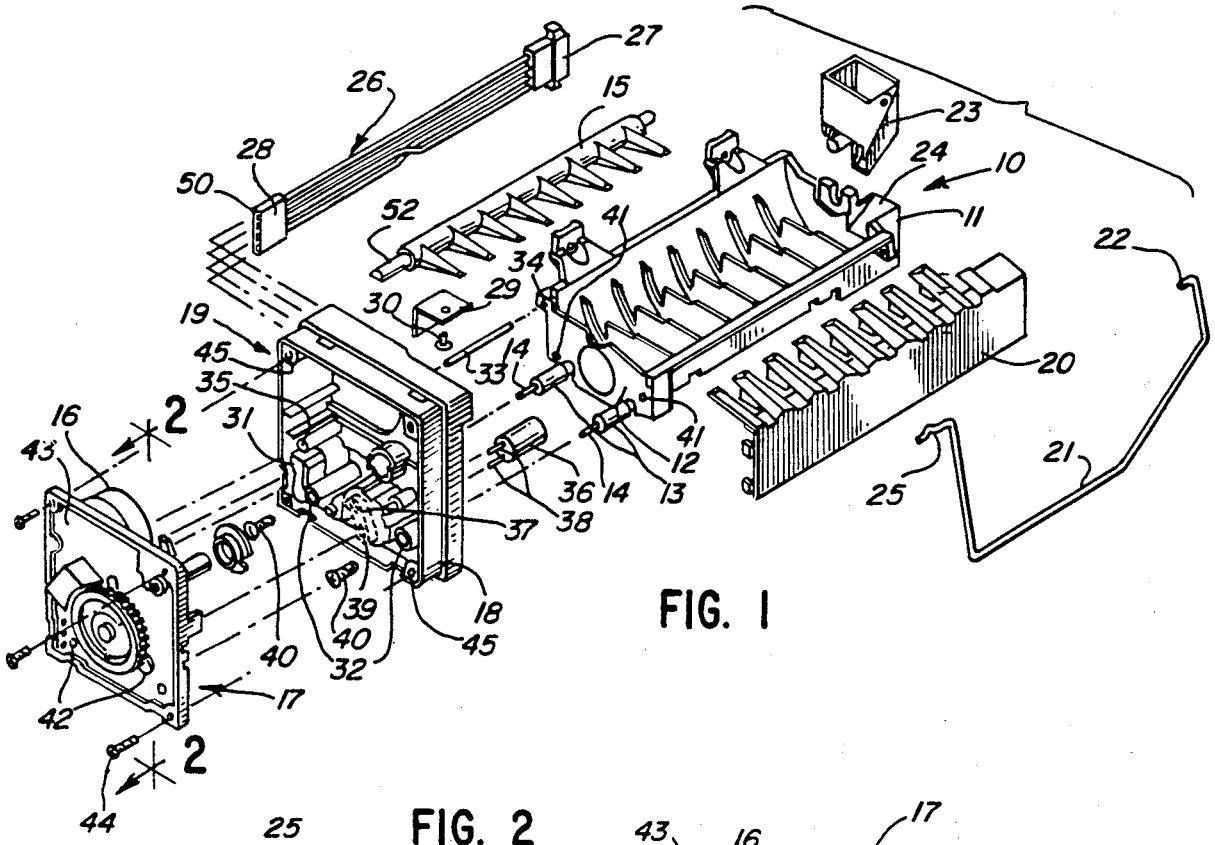
FIG. 1
FIG. 2
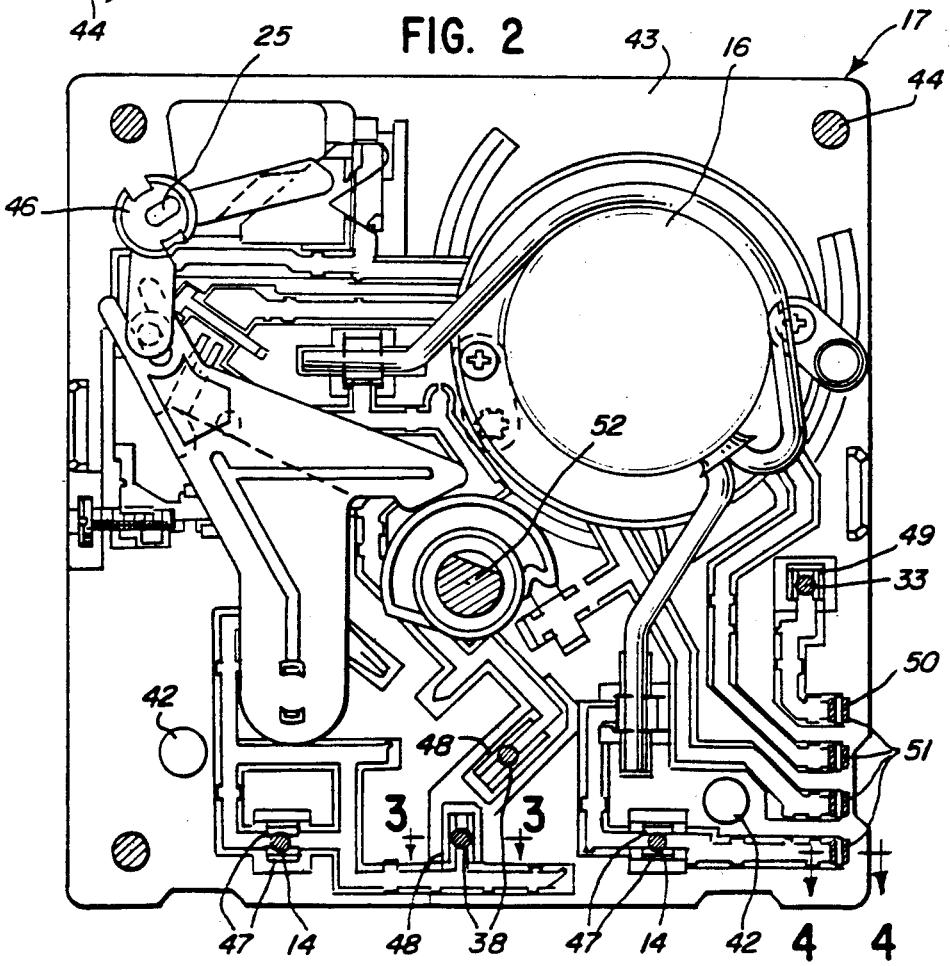
FIG. 3
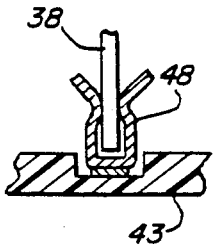
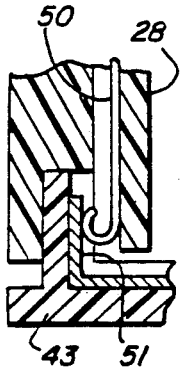
FIG. 4

ICE MAKER ASSEMBLY AND METHOD OF ASSEMBLY

CROSS-REFERENCE TO RELATED APPLICATION

This application comprises a divisional of our copending application Ser. No. 810,074, filed Dec. 17, 1985, entitled ICE MAKER ASSEMBLY AND METHOD OF ASSEMBLY.

BACKGROUND OF THE INVENTION

1. Field of the Invention

This invention relates to the manufacture of ice makers such as for use in domestic refrigerators and the like.

2. Description of the Background Art

In one form of ice maker, an ice mold and associated mechanism is mounted in the freezer compartment of a domestic refrigerator/freezer apparatus. An excellent example of such an ice maker is illustrated in U.S. Pat. No. 3,276,225 of William J. Linstromberg, which patent is owned by the assignee hereof.

Such ice makers are provided with resistance heaters for heating the mold upon completion of the forming of the ice bodies therein so as to permit freeing of the ice bodies therefrom for dispensing automatically to a subjacent collecting bin. One end of the mold is mounted to a support portion of as control housing. Projecting ends of the mold heaters extend through the support to within the housing where terminating wire leads are attached for connection to other components, as illustrated in FIG. 4 of the Linstromberg patent.

A thermal overload protection thermostat is mounted to the support for thermal transfer contact with the end wall of the mold. Conventionally, the thermostat is secured to the support by a bracket retained thereto by a screw passing through an eyelet connected to a ground wire, and also threaded into the mold for grounding the mold concurrently.

A pair of limit switches are actuated by a cam driven by a drive motor, as illustrated in FIG. 15 of U.S. Pat. No. 3,276,255. As shown, these elements are mounted to the inside surface of a plate covering the support.

Power is provided to the control mechanism through a wiring harness by means of hand-secured electrical connectors, screw terminals, and conventional threaded wire nuts. Such electrical connections are relatively expensive and time consuming, and because of the complexity of the circuitry, errors in effecting such connections occur from time to time in manufacture.

Further, if the thermostat or motor requires replacement, the motor and switch assembly must first be removed and the wiring disconnected to permit the desired replacement. If the mold heater requires replacement, the motor and switch assembly must first be removed, and the support separated form the mold to provide access to the heater. This effectively constitutes a disassembly of the entire ice maker.

SUMMARY OF THE INVENTION

The present invention comprehends an improved ice maker assembly and method of assembling the same which permits facilitated and economical manufacture of the ice maker and facilitated replacement of the electrical components when necessary.

The assembly may be effected by automated assembly techniques, and more specifically, the interconnections of the electrical components may be effected as an incident of the assembly of the mechanical components of the ice maker. Reversely, replacement of the electrical components may be readily effected without the need for complete disassembly of the ice maker.

More specifically, the electrical connections between the mold heater carried by the ice maker mold and the power supply terminals carried by the control means, in turn carried by the support to which one end of the mold is connected, are effected as an incident of the mounting of the mold to the support as a result of the extension of terminals on the mold heaters through suitable openings in the mold support wall.

The present invention further comprehends the provision of a recess in the support wall in which the mold thermal overload thermostat is mounted. Means are provided for biasing the thermostat outwardly from the recess intto facial abutment with the end of the mold connected to the support so as to have thermal transfer association with the mold as an incident of the mounting of the mold to the support.

The thermostat also is provided with terminals which project inwardly through openings in the support wall to have electrical connection to terminals on the control means.

A grounding pin is mounted to the mold which also extends through an opening in the support wall to provide a grounded connection between the mold and ground means associated with the control means.

An end connector of the wiring harness is mounted to the support to extend through the wall so as to have electrical connection with complementary electrical terminal means of the control means, also as an incident of assembly of the apparatus.

Fastening means are provided for securing the control means and support as a unit to the end of the mold, permitting the control means and support to be removed as a unit by simple axial withdrawal from the projecting terminals of the mold heater. Thus, the mold heater may be readily replaced upon such removal of the assembled control means and support and the apparatus reassembled with the terminals of the replacement mold heater brought through the openings in the support into automatic electrical connection engagement with the terminals in the control means housing.

Similarly, upon removal of the control means and support from the end of the mold, the thermostat may be replaced by the axial withdrawal from the recess. The replacement thermostat terminals are automatically connected to the terminals in the control means upon installation of the replacement thermostat in the recess by the extension of the terminals thereof through the associated openings in the support wall.

More specifically, the invention comprehends the provision of an improved ice maker assembly including an ice mold defining an inner mold surface, first electrical contact means extending inwardly from the surface, a support defining a wall, the wall defining an outer support surface, an inner support surface, and a through opening in the wall opening through the support surfaces, the mold inner surface being juxtaposed to the outer support surface with the first electrical contact means extending through the opening, control means juxtaposed to the inner support surface, and second electrical contact means carried by the control means in registry with the first electrical contact means, permitting the first and the second contact means to be electrically connected as an incident of assembly of the ice maker.

Further more specifically, the assembly may include means defining a recess in the support all opening toward the mold inner surface, a sensor in the recess, biasing means for biasing the sensor into contact with the mold inner surface, third electrical contact means extending inwardly from the sensor to the control means, and fourth electrical contact means carried by the control means in registry with the third electrical contact means, permitting the third and fourth electrical connecting means to be electrically connected as an incident of assembly of the ice maker.

Still further more specifically, the invention comprehends the provision of such an ice maker assembly further including a drive means mounting to the control means and a load associated with the ice mold to be driven by the drive means, and means for connecting the drive means to the load for driving the load as a incident of assembly of the ice maker.;

Still further, the invention comprehends the method of assembling an ice maker including the steps of forming a support having a wall provided with spaced first and second through openings, the wall defining an inner surface and an outer surface defining an outwardly opening recess therein, providing a sensor in the recess, the sensor defining an inner portion, and an outer portion adjacent the outer surface, the sensor having through first electrical contact means projecting inwardly from the inner portion through the first through opening, providing an ice mold having an inner surface adjacent the support surface, the sensor outer surface abutting the ice mold inner surface, the ice mold having second electrical contact means extending from the inner surface through the support wall second through opening, and providing control means juxaposed to the support wall inner surface, the control means having third electrical contact means positioned to mate with the first electrical contact means, and fourth electrical contact means positioned to mate with the second electrical contact means as an incident of assembly of the ice maker.

Still further more specifically, the invention comprehends the provision of such an ice maker assembly further including a drive means mounted to the control means and a load associated with the ice mold to be driven by the drive means, and means for connecting the drive means to the load for driving the load as an incident of assembly of the ice maker.

Still further, the invention comprehends the method of assembling an ice maker including the steps of forming a support having a wall provided with spaced first and second through openings, the wall defining an inner and an outer surface defining an outwardly opening recess therein, providing a sensor in the recess, the sensor defining an inner portion, and an outer portion adjacent the outer surface, the sensor having through first electrical contact means projecting inwardly from the inner portion through the first through opening, providing an ice mold having an inner surface adjacent the support wall outer surface, the sensor outer surface abutting the ice mold inner surface, the ice mold having second electrical contact means extending from the inner surface through the support wall second through opening, and providing control means juxtaposed to the support wall inner surface, the control means having third electrical contact means positioned to mate with the first electrical contact means, and fourth electrical contact means positioned to mate with the second electrical contact means as an incident of assembly of the ice maker.

Still further, the invention comprehends the provision of such a method of assembling an ice maker further including the step of providing a third spaced through opening in the support wall and a wiring harness having fifth electrical contact means extending through the support wall third through opening, the control means having sixth electrical contact means positioned to mate with the fifth electrical contact means as an incident of assembly of the ice maker.

An ice level sensing arm is provided for sensing the level of ice bodies in the collecting bin for automatically terminating operation of the ice maker when the level reaches a preselected level therein. In the present invention, the shutoff arm includes an end portion extending through an opening in the support wall and connected to the operator for the shutoff switch carried by the control means. Thus, the removal of the assembled control means and support automatically disconnects the end of the shutoff arm, and the replacement thereof on the end of the mold automatically reconnects the end of the shutoff arm to the switch operator.

Thus, the invention comprehends an improved simplified mounting arrangement, permitting automatic electrical connection for facilitated manufacture and servicing in a novel and simple manner.

BRIEF DESCRIPTION OF THE DRAWING

Other features and advantages of the invention will be apparent from the following description taken in connection with the accompanying drawing wherein:

FIG. 1 is an exploded perspective view of an ice maker assembly embodying the invention;

FIG. 2 is an elevation of the control means taken along the line 2—2 of FIG. 1;

FIG. 3 is a fragmentary section taken substantially along the line 3—3 of FIG. 2; and FIG. 4 is a fragmentary section taken substantially along the line 4—4 of FIG. 2.

DESCRIPTION OF THE PREFERRED EMBODIMENT

In the illustrative embodiment of the invention as disclosed in the drawing, an ice maker assembly generally designated 10 embodying the invention is shown, in FIG. 1, to comprise an ice maker mold 11 having an end portion 12. A U-shaped mold heater 13 is mounted on the mold. Each end of mold heater 13 is provided with an outwardly projecting male terminal 14.

A rotatable ejector 15 is driven by a drive motor 16 of a control mechanism 17 removably secured to a support wall 18 cooperatively defining therewith a housing generally designated 19.

An ice stripper 20 is mounted to the mold for cooperation with the ejector in harvesting the ice bodies from the mold after they are first loosened therefrom by energization of the heater 13.

A U-shaped shutoff arm 21 is provided for sensing the level of ice bodies collected in a receptacle (not shown) subjacent the ice maker and includes an outer inturned end 22 pivotally mounted to a water inlet element 23 removably carried on an outer end portion 24 of the mold.

An inner turned end 25 of the shutoff arm 21 extends through an opening in support wall 18 to be driven by the control mechanism 17 in effecting the automatic level sensing operation of the mechanism in the conventional manner.

The ice maker assembly further includes a wiring harness 26 having an outer connector 27 for receiving electrical power for operating the mechanism. The opposite end of the harness is provided with a female connector 28 which projects through an opening 31 in the support wall 18.

As further shown in FIG. 1, support wall 18 further defines a pair of spaced through openings 32 for passing the inner ends and terminals 14 of the mold heater 13 therethrough.

A grounding pin 33 is pressed into the inner end portion 12 of mold 11 in a suitable recess 34 thereof to extend through a through opening 35 in the support wall 18, as an incident of the assembly of the mold to the support wall.

A mold temperature-responsive thermostat 36 is removably mounted in an outwardly opening recess 37 in the support wall 18 and includes a pair of male terminals 38 projecting through a pair of through openings 39 in the support wall at the inner end of the recess 37.

Thermostat 36 is resiliently biased outwardly into facial engagement with the end portion 12 of mold 11 when the mold is assembled to the support 18, thereby providing improved heat transfer contact between the thermostat and mold end portion. At the same time, the mold end portion urges the thermostat firmly into the recess 37 for desired disposition of the terminals 38 in extension through the openings 39. For details of the thermostat mounting, reference is made to U.S. patent application Ser. No. 810,027, entitled "Thermostat Mounting", filed Dec. 17, 1984 by Ralph Tate, Jr. et al. and owned by the assignee of the present invention, which is hereby incorporated by reference.

A pair of screws 40 extend through the support wall 18 into threaded holes 41 in the end portion 12 of the mold for securing the mold to the support wall 18. A pair of openings 42 are provided in the outer wall 43 of the control mechanism 17 to permit threading of screws 40 into and from threaded openings 41 therethrough.

Screws 44 extend through wall 43 into threaded holes 45 in the support wall 18 for removably securing the control mechanism to the support wall. When so secured, openings 42 register with the screws 40, permitting the assembled control mechanism 17 and support wall 18 to be maintained as a unit while permitting removal of the mold from the support wall to expose the mold heater and thermostat 36, as for replacement thereof.

Referring to FIG. 2, the interconnection between the elements extending inwardly through the support wall 18 into association with control mechanism 17 are illustrated in greater detail. Thus, the end 25 of shutoff arm 21 is removably received within a recess 3 of a shutoff switch actuator 46 mounted to the inner surface of the control mechanism wall 43.

Heater terminals 14 are electrically connected to the female contacts 47 of control mechanism 17 solely as an incident of the mounting of the mold 11 to the housing 19, comprising the control mechanism 17 mounted to support 18.

Similarly, thermostat terminals 38 are electrically connected to the female contacts 48 of control mechanism 17 solely as an incident of the mounting of the thermostat in the recess 37 of support wall 18, with the control mechanism 17 mounted to the support wall.

Ground pin 33 is electrically connected to the female contact 49 solely as an incident of the mounting of the mold 11 to the support wall 18, with the control mechanism 17 mounted thereto.

The female contacts 50 of harness connector 28 are electrically connected to male terminals 51 of the control mechanism solely as an incident of the snap-fit mounting of connector 28 to the support wall 18, with the control mechanism 17 mounted thereto.

Illustrative arrangements of the electrical connections are illustrated in greater detail in FIGS. 3 and 4, it being understood that any suitable axially makeable electrically connecting means may be utilized within the scope of the invention.

Thus, the invention comprehends an improved ice maker assembly and method of assembly thereof wherein the mold carries electrically operable means with means for connecting the electrically operable means to the electrical control means through at least one opening in a support as an incident of mounting of the mold to the support, with the control means removably mounted thereto. The invention further comprehends the provision of mold temperature sensing means placed into thermal contact with the mold as an incident of mounting of the mold to the support, with the sensing means captured therebetween.

Still further, the invention broadly comprehends the provision in such an ice maker apparatus of sensing means including means for connecting the sensing means to the electrical control means through at least one opening in the support as an incident of positioning the sensing means in association with the support and with the control means mounted to the support.

Still further, the invention comprehends the provision in such structure of grounding means mounted to the mold and connected to the control means through at least one opening in the support as an incident of mounting of the mold to the support, with the control means removably mounted thereto.

Still further, the invention comprehends the provision of electrical power means in such an ice maker structure connected to the control means through at least one opening in the support as an incident of mounting a portion of the power means to the support, with the control means removably mounted thereto.

The invention further comprehends the provision of sensing means mounted to the mold mechanically connected to the electrical control means through at least one opening in the support as an incident of mounting of the mold to the support, with the control means removably mounted thereto.

As further shown in FIG. 1, the ice ejector 15 includes an end portion 52, which is mechanically connected to the control mechanism 17 as an incident of the mounting of the mold 11 to the support 18, with the control mechanism 17 mounted thereto.

The novel arrangement of the ice maker structure facilitates the use of automated equipment in the assembly thereof. Thus, the mold assembly, including the heater 13, water inlet element 23, ice ejector 15, and ice stripper 20 assembled thereto, is mounted to the support wall 18, with the thermostat 36 installed in the recess 37 of the support wall. The control mechanism may be mounted to the support wall prior to the mounting of the mold and thermostat thereto, or may be mounted to the support wall subsequently thereto, as desired. In either method of assembly, the electrical connections are made solely as an incident of the assembly of the mold, support wall, and control mechanisms.

As indicated above, the provision of the openings 42 in the control mechanism wall 43 permits the replacement of the heater and thermostat, as desired, without the need for disassembly of the control mechanism from the support wall 18 by providing suitable access to the screws 40 removably mounting the support wall 18 to the end portion 12 of mold 11.

The foregoing disclosure of specific embodiments is illustrative of the broad inventive concepts comprehended by the invention.

We claim:

1. A method of assembling an ice maker comprising the steps of:

forming a support having a wall provided with spaced first and second through openings, said wall defining an inner surface and an outer surface defining an outwardly opening recess therein;

providing a sensor in said recess, said sensor defining an inner portion, and an outer portion adjacent said outer surface said sensor having first electrical control means projecting inwardly from said inner portion through said first opening;

providing an ice mold having an inner surface adjacent said support wall outer surface, said sensor outer surface abutting said ice mold inner surface, said ice mold having second electrical contact means extending from said inner surface through said support wall second through opening; and providing control means juxtaposed to said support wall inner surface, said control means having third electrical contact means positioned to mate with said first electrical contact means, and fourth electrical contact means positioned to mate with said second electrical contact means as an incident of assembly of said ice maker.

2. The method of assembling an ice maker of claim 1 further comprising the step of providing a third spaced through opening in said support wall and a wiring harness having fifth electrical contact means extending through said support wall third through opening, said control means having sixth electrical contact means positioned to mate with said fifth electrical contact means.

3. A method of assembling an ice maker comprising:

forming a support housing having a generally planar wall, said wall having edge means for defining openings therein at spaced-apart locations, said planar wall defining a first surface and a second surface opposite said first surface, said second surface defining a recess therein;

registering a sensor within said recess of said housing second surface, said sensor defining a first face and a second face spaced from said first face, said sensor having a first electrical contact extending from said first face, said first electrical contact traversing said housing wall in one said opening;

registering an ice mold having a generally planar face with said support housing and said sensor, said ice mold face abutting said housing second surface and said sensor second face, said ice mold having a second electrical contact extending from said ice mold face and traversing said support housing wall in a second said opening; and registering a control module having a generally planar face with said support housing first surface, said control module having a third electrical contact extending from said module face and positioned to mate with said first electrical contact, said control module having a fourth electrical contact extending from said module face and positioned to mate with said second electrical contact.

4. The method of assembling an ice maker of claim 3 further comprising the step of registering a wiring harness having a fifth contact with said support housing second surface, said fifth contact traversing said support housing wall in a third said opening, said control module having a sixth electrical contact extending from said module face and positioned to mate with said fifth electrical contact.

5. A method of assembling an ice maker comprising the steps of:

providing an ice mold defining an inner mold surface;

associating ice ejecting means with said mold;

providing first electrical contact means extending inwardly from said surface;

providing a support defining a wall, said wall defining an outer support surface, an inner support surface, and a through opening in said wall opening through said support surfaces;

disposing said mold inner surface adjacent to said outer support surface with said first electrical contact means extending through said opening;

providing means carried by said support for mechanically operating said ice ejection means;

disposing control means adjacent to said inner support surface;

providing second electrical contact means on said control means in registry with said first electrical contact means; and causing said first and second electrical contact means to be electrically connected to each other and said means for mechanically operating said ice ejection means to be connected to said ice ejection means as an incident of the juxtaposition of the mold inner surface and outer support surface in the assembly of said ice maker.

6. The method of assembling an ice maker of claim 5 further comprising the steps of:

providing a recess in said support wall opening toward said mold inner surface;

providing a sensor in said recess;

biasing means for biasing said sensor into contact with said mold inner surface;

providing third electrical contact means extending inwardly from said sensor to said control means;

providing fourth electrical contact means in said control means in registry with said third electrical contact means; and causing said third and fourth electrical contact means to be electrically connected as an incident of assembly of said ice maker.

7. The method of assembling an ice maker comprising the steps of:

providing an ice mold defining a generally planar face;

associating ice ejection means with said mold;

providing first electrical contact means for carrying current to said mold to extend outwardly from said mold planar face;

providing a support housing having a wall defining a first planar surface and a second planar surface opposite said first planar surface, and an opening through said wall;

abutting said mold planar face to said support housing first planar surface with said first contact means traversing said housing wall in said opening;

providing means on said support for mechanically operating said ice ejection means;

providing a control module defining a face juxtaposed to said support housing second planar surface; and providing second electrical contact means for carrying current to said control module to extend outwardly from said control module face in registry with said first electrical contact means, thereby causing said first and said second contact means to be electrically interconnected and said means for mechanically operating said ice ejection means to be connected to said ice ejection means as an incident of the juxtaposition of said mold inner surface and outer support surface in assembling said ice maker.

8. The method of assembling an ice maker comprising the steps of:

providing an ice mold defining a generally planar face;

associating ice ejection means with said mold;

providing first electrical contact means for carrying current to said mold to extend outwardly from said mold planar face;

providing a support housing having a wall defining a first planar surface and a second planar surface opposite said first planar surface, and an opening through said wall;

abutting said mold planar face to said support housing first planar surface with said first contact means traversing said housing wall in said opening;

providing means on said support for mechanically operating said ice ejection means;

providing a control module defining a face juxtaposed to said support housing second planar surface;

providing second electrical contact means for carrying current to said control module to extend outwardly from said control module face in registry with said first electrical contact means, thereby causing said first and said second contact means to be electrically interconnected and said means for mechanically operating said ice ejection means to be connected to said ice ejection means as an incident of the juxtaposition of said mold inner surface and outer support surface in assembling said ice maker;

providing a second aperture in said housing wall in registry with said mold planar face;

providing a sensor in said aperture;

providing biasing means biasing said sensor into contact with said mold planar face;

providing a third electrical contact means for carrying current to said sensor to extend outwardly from said sensor in a direction toward said control module;

providing a fourth electrical contact means for carrying current to said control module to extend outwardly from said control module face; and causing said third and said fourth contact means to electrically interconnect as an incident of assembling said ice maker.

9. The method of assembling an ice maker comprising the steps of:

providing a mold;

providing electrically operable means;

providing mechanically operable means in assocation with the mold;

providing a support having openings therethrough;

removably mounting electrical control means to the support;

removably mounting means for mechanically operating said mechanically operable means to the support; and connecting said electrically operable means to the electrical control means through at least one opening in said support and connecting said mechanically operable means to said means for mechanically operating the same as an incident of connecting said mold to said support.

10. The method of assembling an ice maker structure of claim 9 further including the step of placing sensing means in contact with said mold as an incident of mounting said mold to said support with said sensing means captured therebetween.

11. The method of assembling an ice maker structure of claim 9 further including the step of placing sensing means in contact with said mold as an incident of mounting said mold to said support with said sensing means captured therebetween, and connecting the sensing means to the electrical control means through at least one opening in said support as an incident of positioning said sensing means in association with said support and with said control means mounted to said support.

12. The method of assembling an ice maker of claim 9 further including the step of mounting grounding means to said mold and connecting the grounding means to said control means through at least one opening in said support as an incident of mounting said mold to said support with said sensing means captured therebetween.

13. The method of assembling an ice maker of claim 9 further including the step of mounting sensing means to said mold and mechanically connecting the sensing means to said electrical control means through at least one opening in said support as an incident of assembly of said ice maker.

* * * * *